United States Patent [19]

Escamilla

[11] 4,069,619

[45] Jan. 24, 1978

[54] RESURFACING DEVICE FOR SCREWDRIVERS AND LIKE TOOLS

[76] Inventor: Abraham S. Escamilla, 1824 10th Ave., Scottsbluff, Nebr. 69361

[21] Appl. No.: 712,497

[22] Filed: Aug. 9, 1976

[51] Int. Cl.[2] ..... B24B 3/60; B24B 23/00

[52] U.S. Cl. ..... 51/3; 51/80 R; 51/102; 51/128; 51/173; 76/89

[58] Field of Search ..... 51/31, 40, 71, 80, 82, 51/102, 111 R, 116, 128, 170 R, 170 PT, 170 T, 173; 29/76 R, 78, 103; 76/86, 87, 89, 101 D

[56] References Cited

U.S. PATENT DOCUMENTS

| | | | |
|---|---|---|---|
| 1,068,973 | 7/1913 | Brown | 76/87 |
| 1,699,980 | 1/1929 | Marshall | 51/80 R |
| 1,831,863 | 11/1931 | Irwin | 51/116 X |
| 2,165,118 | 7/1939 | White | 51/80 R |
| 2,249,084 | 7/1941 | Kobos | 76/87 |
| 2,653,421 | 9/1953 | Kobos | 51/80 |
| 2,690,034 | 9/1954 | Laverdisse | 51/112 |
| 3,165,813 | 1/1965 | Harvell | 29/103 X |
| 3,341,981 | 9/1967 | Baronyak | 51/219 R X |
| 3,805,455 | 4/1974 | Aellig | 51/80 A |

FOREIGN PATENT DOCUMENTS

| | | | |
|---|---|---|---|
| 641,870 | 6/1932 | Germany | 51/40 |

OTHER PUBLICATIONS

Nicholson File Company, Catalog on Rotary Files, 3 pages.

*Primary Examiner*—Harold D. Whitehead
*Assistant Examiner*—Nicholas P. Godici
*Attorney, Agent, or Firm*—Ancel W. Lewis, Jr.

[57] ABSTRACT

A resurfacing device for screwdrivers and like tools has two sets of rotary grinding members provided with grinding portions arranged along two intersecting planes at right angles to one another. One of the sets of rotary grinding members is mounted to rotate about a first axis to provide a first pair of opposed grinding portions and the other of the sets of rotary grinding members is mounted to rotate about a second axis to provide a second pair of opposed grinding portions. Each rotary grinding member of each set is yieldably urged toward the other of that set to urge each associated pair of opposed grinding portions against surfaces of a tool disposed therebetween. One set of the rotary grinding members is disposed opposite the other set to further provide the two pairs of opposed peripheral grinding portions that are disposed along the other of said intersecting planes. For accommodating a wider range of screwdriver sizes one set of rotary grinding members is movable relative to the other and yieldably urged toward the other to urge grinding portions against a tool. The two sets of rotary grinding members are driven in opposite directions by a motor, preferably a drill-type motor, removably mounted on a support housing for the grinding members. A first guide selectively positions a tool along an axis defined by said intersecting planes or along one of said intersecting planes for engagement by associated grinding portions. A second tool guide selectively positions a tool for grinding by one of the exterior grinding portions of one of the grinding wheels either perpendicular to or at a selected angle relative to the longitudinal axis of the tool. One form of grinding member has file-like ridges on at least one side and the periphery of a generally thin disc-shaped body.

18 Claims, 16 Drawing Figures

RESURFACING DEVICE FOR SCREWDRIVERS AND LIKE TOOLS

FIELD OF THE INVENTION

This invention relates generally to resurfacing devices for tools and more particularly to a novel resurfacing device for screwdrivers and like tools.

BACKGROUND OF THE INVENTION

Screwdrivers and like tools have tips, flat surfaces and edges that become worn down, chipped or otherwise damaged during usage so as to make them generally ineffective for the purposes intended. These tools, however, are capable of being resurfaced to restore their usefulness. Present practices, however, are to discard worn screwdrivers once the tip is chipped or worn dull, and of course this results in waste of a potentially good tool and requires replacement with a new tool that is expensive as compared to resurfacing. A simple approach to resurfacing is to use a single grinding wheel, but this lacks a degree of precision and accuracy and therefore is not entirely satisfactory. Some attempts have been made to provide special devices for grinding or resurfacing screwdrivers but these have not been found to be entirely satisfactory, usually due to either inconvenience or difficulty in use, expense, or the inability to do a fast, accurate resurfacing job.

Accordingly, it is an object of the present invention to provide a novel resurfacing device for screwdrivers and like tools that is simple, lightweight, readily portable, and is suitable for resurfacing conventional flat-tipped screwdrivers as well as Phillips screwdrivers.

Another object of this invention is to provide a resurfacing device for screwdrivers and like tools having a variety of sizes and shapes.

Yet a further object of the present invention is to provide a resurfacing device for screwdrivers and like tools that is fast and accurate in grinding the several surfaces of a tool that require resurfacing without requiring undue manipulation and/or a relatively complex structure.

Still another object of the present invention is to provide a resurfacing device for tools adapted to be constructed as a portable unit and power-driven preferably by a removable electric drill motor or the like.

Yet another object of the present invention is to provide a resurfacing device in the form of a relatively thin discshaped body having file-like ridges on at least one side and on the periphery to grind tool surfaces upon the rotation thereof.

Still a further object of this invention is to provide a novel resurfacing device for screwdrivers of various types and sizes characterized by the provision of grinding portions along two intersecting planes at right angles to one another and along at least one exterior surface along with tool positioning guides to accurately position surfaces to be ground.

Other objects, advantages and capabilities of the present invention will become more apparent as the description proceeds taken in conjunction with the accompanying drawings, in which like parts have similar reference numerals and in which.

Figure 1:
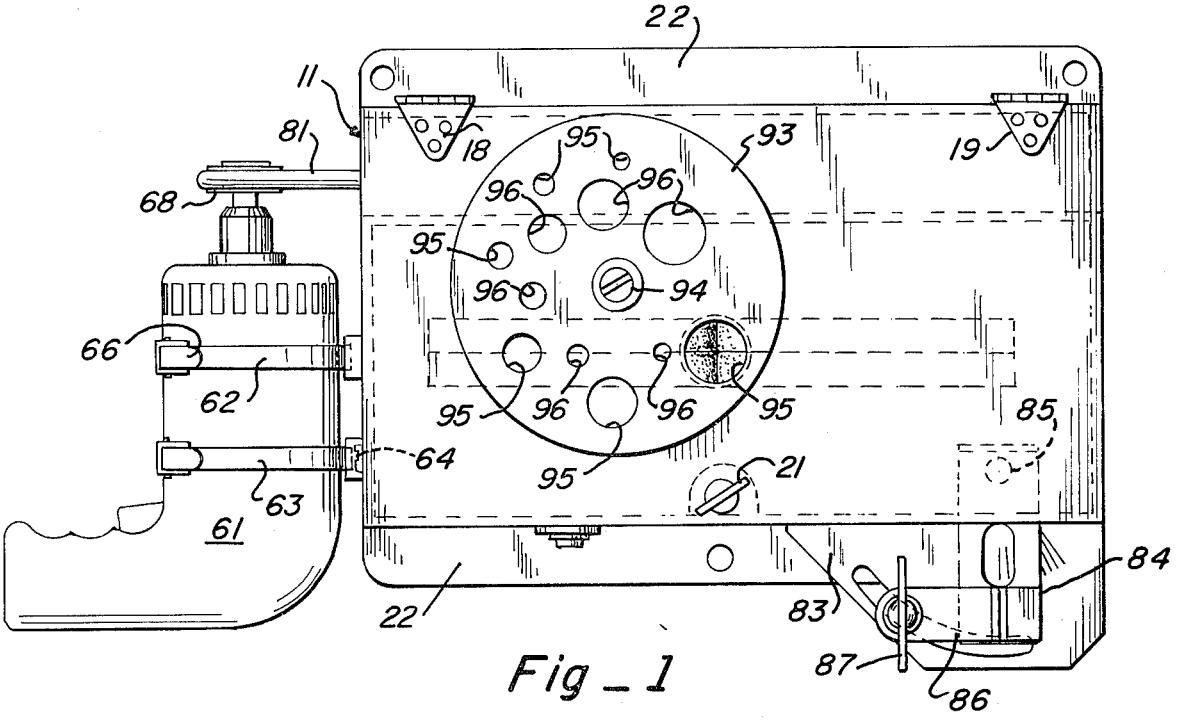
FIG. 1 is a top plan view of a portable resurfacing device embodying features of the present invention.

Referring now to the drawings, the portable resurfacing device shown has a generally box-shaped housing 11 comprised of a bottom wall 12, front wall 13, rear wall 14, a pair of opposed end walls 15 and 16, and a cover or top wall 17 pivotally mounted for movement between an open position and a closed position by a pair of hinges 18 and 19 connected between the top wall 17 and rear wall 14. A nut 21 is shown threaded into a block supported by wall 13 to releasably secure the cover 17 to the front end wall in a closed position. The bottom wall 12 has flange extensions 22 projecting out from the front and rear walls that are provided with apertures to facilitate the mounting and affixing of the device on a table surface or the like as required.

Figure 4:
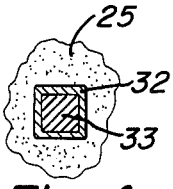
FIG. 4 is a sectional view taken along lines 4—4 of FIG. 3 showing a fragment of the rotary grinding wheels.

Within the housing 11 there is mounted a set of rotary members in the form of a set of grinding wheels 24 and 25 of a corresponding size and shape on a shaft 26. Shaft 26 is mounted for rotation in the front wall 13 and an intermediate wall 27 spaced from and parallel to the front wall 13 and rear wall 14. Shaft 26 is journaled in a suitable bearing 30 in front wall 13 and bearing 31 in wall 27. The grinding wheels 24 and 25 are shown in FIG. 4 to have a sleeve 32 with a square aperture and the shaft 26 has a square section 33 to suitably key the grinding wheels to the shaft 26 to rotate with the shaft but there is sufficient clearance so the wheels are slidable along the associated shaft toward and away from one another. A resilient bias member in the form of a coil spring 34 is shown with accompanying washers 35 and 36 at each end which fits over shaft 26 and is positioned between the grinding wheel 25 and bearing 31 in intermediate wall 27. In a like manner a coil spring 38 with washers 41 and 42 at each end fits over shaft 26 and is positioned between the bearing 30 in the front wall 13 and the grinding wheel 24. These springs 34 and 38 yieldably urge grinding wheels 24 and 25 toward one another and at the same time spread apart under the compression of the springs when a screwdriver is inserted therebetween as described more fully hereinafter.

There is further provided a set of rotary members in the form of grinding wheels 52 and 53 of a corresponding size and shape. Wheels 52 and 53 are also of a corresponding size and shape with wheels 24 and 25 above described. Wheels 52 and 53 are mounted on a shaft 54 journaled in a bearing 55 in wall 27 and bearing 56 in wall 13. These grinding wheels are also suitably keyed to the shaft using complementary, square-shaped cross sections in the same manner as shown in FIG. 4 for rotation with the shaft and are slidable along the shaft toward and away from one another. A coil spring 58 shown in accompanying washers at each end, as with the springs 34 and 38 previously described, is positioned between the bearing 55 in the intermediate wall 27 and the grind wheel 53. Similarly, a coil spring 57 is positioned between the bearing 56 in the front wall 13 and grinding wheel 52 to resiliently urge the grinding wheels 52 and 53 toward and against one another and at the same time spread apart under compression when a tool is inserted therebetween.

Figure 5:
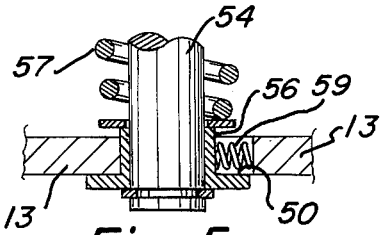
FIG. 5 is a sectional view taken along lines 5—5 of FIG. 2.

For the purpose of accommodating screwdrivers of a wider range of sizes, the rotary shaft 54 supporting grinding wheels 52 and 53 is constructed to move away from shaft 26 and this is accomplished by providing an elongated slot or aperture 50 in each of the walls 27 and 13 that receive shaft 54. This elongated slot 50 is shown in wall 13 in FIG. 5. Each elongated slot 50 carries a resilient member, shown in FIG. 5 as member 59, that urges the set of rotary members 53 and 54 against the set of rotary members 24 and 25. Upon insertion of a screwdriver, then, the one set of rotary members may yield relative to the other to accommodate larger size screwdrivers. While this resilient, yieldable feature for one set of rotary members relative to the other is shown in FIG. 5, it is understood that, for devices adapted to accommodate only smaller screwdrivers, no yieldability is required.

Each of the rotary grinding wheels 24, 25, 31 and 32 shown is of a corresponding size, shape and construction, generally disc-shaped with flat abrasive sides and a flat abrasive periphery so that wheel 24, for example, has flat grinding portions 24a and 24b on opposite sides thereof and a flat peripheral grinding portion 24c. The side grinding portion 24a and peripheral grinding portion 24c form a corner grinding portion 24d. The arrangement of two sets of grinding wheels on two shafts with the wheels movable or slidable along the shaft then provides four corner grinding portions disposed along two intersecting planes at right angles to one another for grinding Phillips screwdrivers, as described fully hereinafter.

An electric drive motor 61 is shown as removably mounted on the end wall 15 of the support housing 11. The mounting may take various forms but as shown is comprised of two straps 62 and 63 affixed to wall 15 by a fastener such as a bolt as shown at 64. Each strap has a male loop 60 that inserts into a female loop 65. Male loop 60 is actuated by a handle 66 and moved between open and closed positions.

Figure 2:
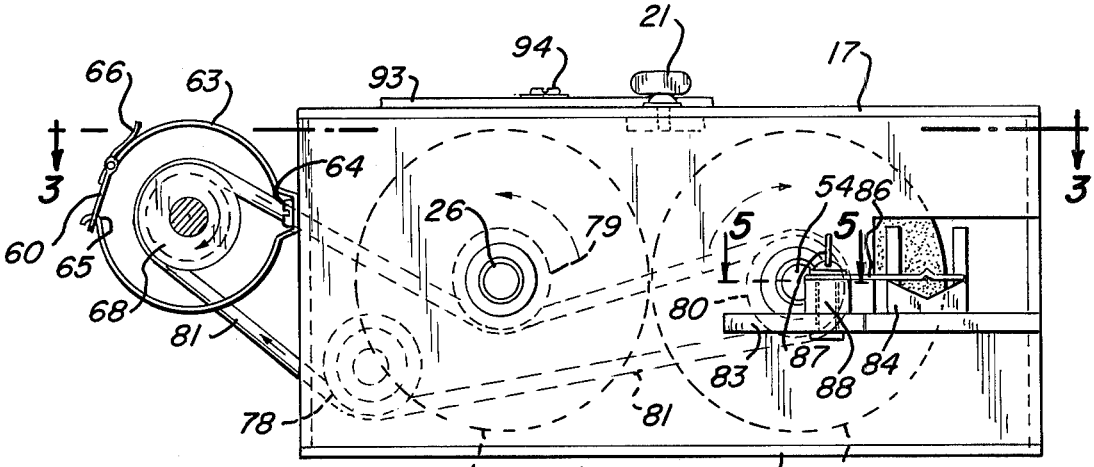
FIG. 2 is a side elevation view of the device of FIG. 1.

The drive train between the motor 61 and shafts 26 and 54 as shown includes a pulley 68 on a shaft removably inserted into the jaws of the drill-type motor 61, a pulley 78 on an idler shaft 75 journaled in a bearing 76 in rear wall 14 and bearing 77 in intermediate wall 27, a pulley 79 on shaft 26 and a pulley 80 on shaft 54. Pulleys 68, 78, 79 and 80 are alined with one another and a belt 81 is trained around pulleys 68 and 80 and bears against the outside of pulley 78 and the inside of pulley 79 to cause the shafts 26 and 54 with their associated pulleys to rotate in opposite directions, as best seen in FIG. 2.

A tool grinding guide is provided for positioning the tip of a tool for grinding perpendicular to or at a selected angle to the longitudinal axis of the tool and includes a stationary horizontal base plate 83 projecting out from the front wall 13 and a tool support 84 having a V-shaped cross section that is pivoted by a pivot member 85 supported by wall 13 adjacent an exterior grinding portion of grinding wheel 52, the pivot member providing a pivot for the support about a vertical axis. The tool support 84 is guided and supported by the base plate 83 and is releasably held by means of a clamping plate 86 disposed parallel to plate 83 and covering the top of the V-shaped groove and a wing nut assembly 87. A spacer 88 rests on the plate 83 and the bolt portion of assembly 87 extends there-through. The bolt portion of the wing nut assembly 56 fits in an arcuate slot 87 in the base plate to provide a guide for the pivotal movement of the tool support to dispose the tool at selected angular positions relative to the adjacent grinding portion of member 52.

Figure 3:
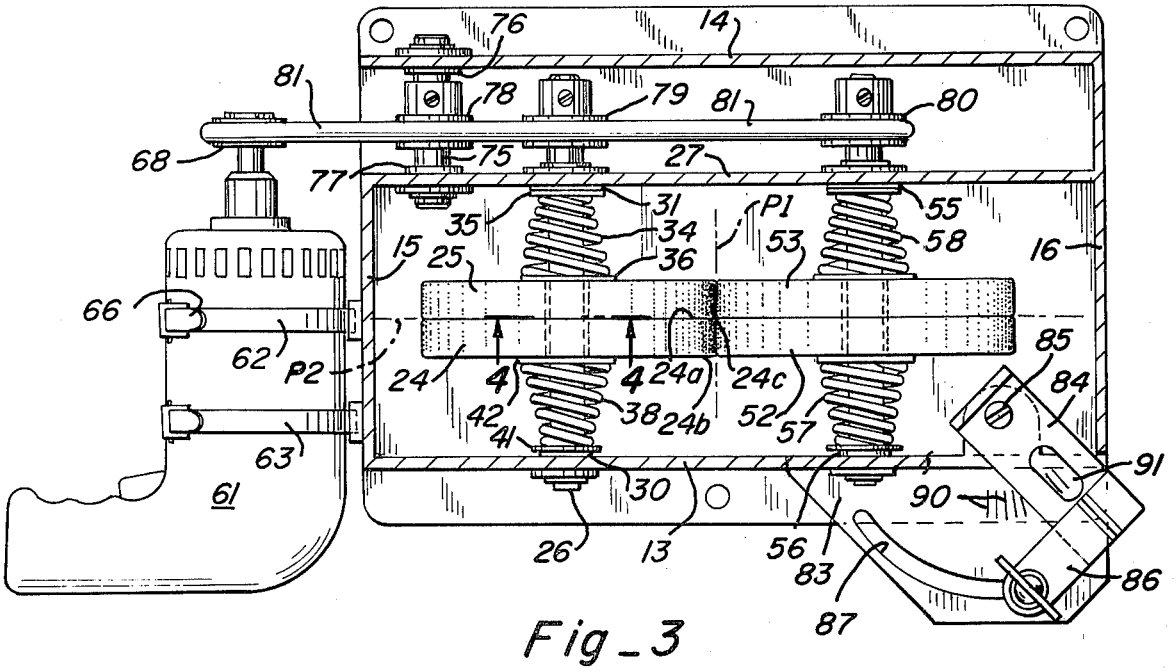
FIG. 3 is a sectional view taken along lines 3—3 of FIG. 2.

The position range for this tool in this guide, then, is from a perpendicular disposition whereby the tip of a screwdriver may be ground flat or perpendicular to the longitudinal axis of the shaft to an inclined attitude as with the flat beveled longitudinal faces of a screwdriver as shown in FIG. 3. The range of angles to the perpendicular can be varied to cover the beveled sides of a Phillips screwdriver, as described hereinafter. Calibration marks 90 in the base plate aline with the center of the tool support via the slot 91 to facilitate the positioning of the tool at a selected angle. The tightening of the wing nut 56 locks the tool in place at the desired angle and the tool may be advanced toward or retracted from the grinding portion.

A rotary guide wheel 93 is mounted for rotation on the top wall 17 on a vertical shaft 94 for rotation about a vertical axis. This guide wheel 93 has a plurality of guide openings 95 of different diameters having a center on a common radius from the center of the wheel that is alined with the intersection of the planes P1 and P2 so that, upon insertion of a screwdriver down into one of the guide openings 95, the four recesses of a Phillips screwdriver are positioned for grinding. The guide wheel 93 is provided with another plurality of openings 96 off-set to one side of openings 95 to position a screwdriver between opposed grinding portions of members 24 and 25.

Figure 6:
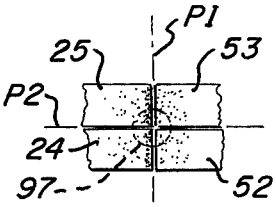
FIG. 6 is a fragmentary top plan view showing the position of a Phillips screwdriver centered in relation to the two intersecting planes and associated grinding portions.
Figure 7:
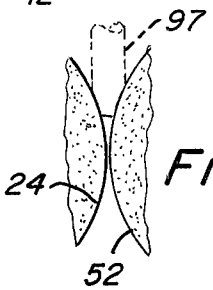
FIG. 7 is a fragmentary side elevation view of the screwdriver and grinding members shown in FIG. 6.

Referring now to FIGS. 6 and 7, a Phillips screwdriver 97 is inserted into a selected guide opening 95 of the guide plate 93 and extends along the axis defined by the intersecting planes P1 and P2. The four corner grinding portions of the four grinding wheels grind into four recessed areas of the screwdriver to accomplish a resurfacing leaving the four ridges of the tool at the tip.

Figure 8:
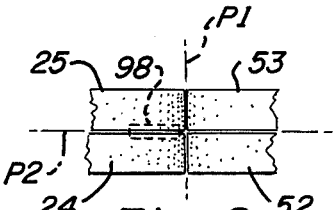
FIG. 8 is a fragmentary top plan view showing the position of a flat-sided screwdriver in relation to one of the two intersecting planes and associated grinding portions.
Figure 9:
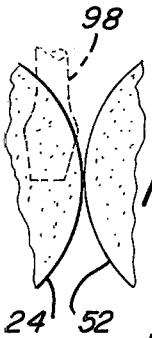
FIG. 9 is a fragmentary side elevation view of the screwdriver and grinding members shown in FIG. 6.

Referring now to FIGS. 8 and 9, the conventional flat-sided screwdriver 98 is inserted into a selected guide hole 96 of the guide plate 93 and this positions the grinding portions along the axis defined by plane P1 between the opposed grinding portions of the grinding members 24 and 25 to grind the flat faces of the screwdriver 98.

Figure 11:
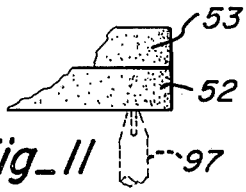
FIG. 11 is a fragmentary top plan view of an exterior grinding surface portion with the tip of a Phillips screwdriver perpendicular to the grinding portion.
Figure 10:
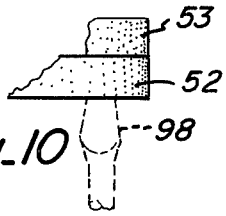
FIG. 10 is a fragmentary top plan view of an exterior grinding surface portion of one of the rotary grinding wheels of FIG. 1 and the flat-sided screwdriver tip disposed perpendicular to the grinding portion.

By the use of the guide support 84 above described, the tip of a flat-sided screwdriver 98 is resurfaced as shown in FIG. 10 or the tip of a Phillips screwdriver as shown in FIG. 11 while the tip is mounted perpendicular to the grinding portion of the rotary member 52.

Figure 12:
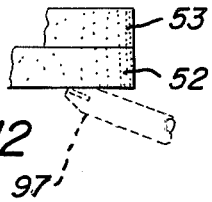
FIG. 12 is a fragmentary top plan view of the grinding surface portion shown in FIG. 8 with a Phillips screwdriver positioned at an angle to the longitudinal axis of the screwdriver.
Figure 16:
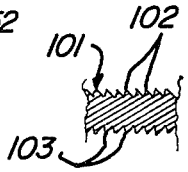
FIG. 16 is a sectional view taken along lines 16—16 of FIG. 15.
Figure 13:
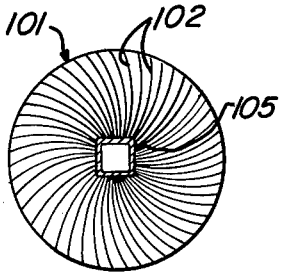
FIG. 13 is a side elevation view of one preferred form of a rotary grinding member.
Figure 14:
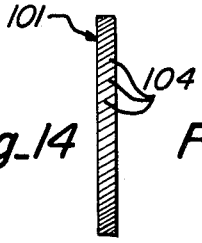
FIG. 14 is an end elevation view of the rotary grinding member of FIG. 13.
Figure 15:
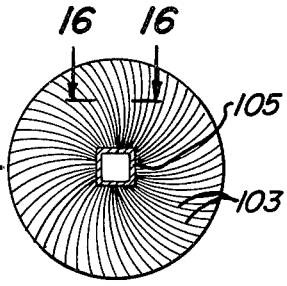
FIG. 15 is a side elevation view of the rotary grinding member of FIG. 13 from the opposite side.

Finally, to resurface or grind a beveled edge, the Phillips screwdriver is positioned on the support 84 located at the desired angle and the appropriate angle ground in the screwdriver as seen in FIG. 12.

Another form of rotary grinding member 101 that is particularly suited for a tool resurfacing operation is illustrated in FIGS. 13 to 16, inclusive. One side of the body has a plurality of file-like spaced ridges 102 arranged in a helical pattern from the center toward the periphery thereof and in the form shown the other side has a plurality of file-like spaced ridges 103 arranged in a helical pattern from the center toward the periphery thereof. For some applications, in the device described only one side need have these grinding ridges. There is further provided on this body a plurality of obliquely arranged file-like ridges 104 that resurface a tool surface positioned thereagainst. The body shown has a hub 105 with a square aperture to slidably fit on shafts 26 and 54 above described. It is understood, however, that other forms of keying for conjoint rotation of the rotary member with the shaft with slidable movement therealong may be provided in the form of rotary members shown in FIGS. 13 to 16, inclusive.

Although the present invention has been described with a certain degree of particularity, it is understood that the present disclosure has been made by way of example and that changes in details of structure may be made without departing from the spirit thereof.

What is claimed is:

1. In a resurfacing device for screwdrivers and like tools, the combination comprising:

two sets of rotary grinding members having grinding portions disposed along two intersecting planes at right angles to one another, a first of said sets being rotatable about a first common axis of rotation having a first pair of opposed grinding portions and a second of said sets being rotatable about a second common axis of rotation having a second pair of opposed grinding portions, said first and second pairs of opposed grinding portions being disposed along one of said intersecting planes, said rotary grinding members of each set being movable toward and away from one another and yieldably urged toward one another and separable against the yieldable urging away from said one of said intersecting planes upon the insertion of a tool therebetween to be resurfaced, the rotary grinding members having a third pair and a fourth pair of opposed grinding portions along the other of said intersecting planes, means for rotating said sets of rotary members in opposite directions; and guide means for positioning a tool along an axis defined by said intersecting planes for guided engagement of selected surfaces of said tool with said grinding portions.

2. In a resurfacing device as set forth in claim 1 wherein one of said sets of rotary grinding members is movable toward and away from the other of said sets and yieldably urged toward the other of said sets and separable against the yieldable urging away in each set to vary the spacing between said third and fourth pairs of opposed grinding portions according to the size of the tool inserted.

3. In a resurfacing device as set forth in claim 1 wherein each of said rotary grinding members is in the form of a generally disc-shaped wheel having grinding portions along opposite sides and along the periphery thereof forming two substantially right angle corner grinding portions.

4. In a resurfacing device as set forth in claim 3 wherein each of said sets of rotary grinding members is mounted for conjoint rotation on a rotary shaft and each is affixed to rotate with and is slidable in both directions along the associated shaft.

5. In a resurfacing device as set forth in claim 3 wherein said grinding portions on the sides and along the periphery are generally flat and made of an abrasive material.

6. In a resurfacing device as set forth in claim 3 wherein said grinding portions on the sides take the form of file-like, spaced ridges arranged in a generally helical pattern from the center toward the periphery thereof and said grinding portions on the periphery take the form of spaced, obliquely arranged file-like ridges.

7. In a resurfacing device as set forth in claim 3 including housing means having opposed walls supporting said rotary shafts and a resilient member disposed between one of the opposed walls of the housing and each of said grinding wheels to yieldably urge the grinding wheels of each set toward one another.

8. In a resurfacing device as set forth in claim 7 wherein said means for rotating includes a drill-type motor releasably mounted on said housing means and a drive train coupled between said motor and said rotary grinding members for the simultaneous rotation thereof.

9. In a resurfacing device as set forth in claim 1 wherein said guide means is in the form of a rotary index wheel having a series of holes of different sizes arranged at spaced intervals on a circumference at a selected distance from the axis of rotation of said wheel that intersects said intersecting planes.

10. In a resurfacing device as set forth in claim 9 wherein said rotary index wheel has a second series of spaced holes of different sizes arranged at spaced intervals on a circumference a selected distance from the axis of rotation of said wheel to position a tool along one of said planes between opposed grinding portions of one of said sets of rotary grinding members.

11. In a resurfacing device as set forth in claim 1 further including a second guide for supporting the tip of a tool normal to one of said grinding portions opposite said intersecting planes and at a selected angle relative to the longitudinal axis of the tool.

12. In a resurfacing device as set forth in claim 11 wherein said second guide includes a base plate, a tool support pivotally mounted on said base plate affording guided movement of a tool toward and away from an associated grinding portion opposite said intersecting planes, and a clamp to clamp the tool on said support at a selected position.

13. In a resurfacing device as set forth in claim 12 wherein said base plate has calibrations to indicate the angular position of the tool relative to the associated grinding portion.

14. A resurfacing device for screwdrivers and like tools comprising:

a support;

a first set of rotary members mounted for conjoint rotation on a first shaft carried by said support, and a second set of rotary members mounted for conjoint rotation on a second shaft arranged substantially parallel to said first shaft and carried by said support, said first and second sets of rotary members having grinding portions disposed along intersecting planes at right angles to one another, said rotary members of each set being slidable along the associated shaft toward and away from one another and yieldably urged toward one another and separable against the yieldable urging along one of said intersecting planes upon the insertion of a tool therebetween to be resurfaced, one of said first and second shafts being movable toward and away from the other and yieldably urged towards the other and separable against the yieldable urging away to vary the spacing between said two sets of rotary grinding members;

means including a drive motor and a drive train between said motor and said shafts for rotating said shafts in opposite directions;

a first tool guide on said support for guiding a tool along an axis defined by said intersecting planes for positioning the tool in said grinding portions; and a second tool guide on said support to support a tool against one of said grinding portions.

15. A resurfacing device as set forth in claim 14 wherein said support includes two opposed walls of a portable housing, said housing having a top closure adapted to move between open and closed positions and flange portions adapted to mount the housing on a supporting surface.

16. A resurfacing device as set forth in claim 14 wherein each of said first and second shafts is journaled in bearings in said support.

17. A resurfacing device as set forth in claim 14 wherein each of said shafts has a generally square-shaped central portion and said rotary members have a hub portion with a complementary, generally square-shaped aperture to key each rotary member to the associated shaft.

18. A resurfacing device as set forth in claim 14 wherein said first and second sets of rotary members form four right-angle corner grinding portions at the intersection of said planes for grinding four ridges in a Phillips screwdriver.

* * * * *